US005775705A

United States Patent [19]

Cochimin

[11] Patent Number: 5,775,705

[45] Date of Patent: *Jul. 7, 1998

[54] CONVERTIBLE IN-LINE/PARALLEL SKATES

[76] Inventor: Jimmy Cochimin, 4431 Fairfield Ave., Fort Wayne, Ind. 46807

[ * ] Notice: The term of this patent shall not extend beyond the expiration date of Pat. No. 5,524,911.

[21] Appl. No.: 780,827

[22] PCT Filed: Jul. 25, 1995

[86] PCT No.: PCT/US95/10082

§ 371 Date: Jan. 10, 1997

§ 102(e) Date: Jan. 10, 1997

[87] PCT Pub. No.: WO96/03187

PCT Pub. Date: Feb. 8, 1996

Related U.S. Application Data

[63] Continuation-in-part of Ser. No. 280,806, Jul. 26, 1994, Pat. No. 5,524,911.

[51] Int. Cl.[6] ..... A63C 17/02

[52] U.S. Cl. ..... 280/7.1; 280/11.22; 280/11.27

[58] Field of Search ..... 280/7.1, 7.12, 280/7.13, 7.15, 841, 11.19, 11.22, 11.27, 11.23, 11.28

[56] References Cited

U.S. PATENT DOCUMENTS

| | | | |
|---|---|---|---|
| 177,566 | 5/1876 | Saladee | 280/11.19 |
| 1,309,493 | 7/1919 | Tyler | 280/7.1 |
| 1,527,840 | 2/1925 | Chomin | 280/7.13 |
| 2,035,897 | 3/1936 | Kosanovich | 280/7.13 |
| 2,512,524 | 6/1950 | Gallo, Jr. | 280/7.1 |
| 2,591,534 | 4/1952 | Gallo et al. | 280/7.15 |
| 3,086,787 | 4/1963 | Wyche | 280/11.19 |
| 3,827,706 | 8/1974 | Milliman | 280/87.04 |
| 3,901,520 | 8/1975 | McMahan | 280/7.13 |
| 4,382,605 | 5/1983 | Hegna | 280/11.22 |
| 4,492,385 | 1/1985 | Olson | 280/7.13 |
| 5,193,827 | 3/1993 | Olson | 280/7.13 |
| 5,295,701 | 3/1994 | Reiber et al. | 280/11.22 |
| 5,372,534 | 12/1994 | Levy et al. | 280/11.22 X |
| 5,524,911 | 6/1996 | Cochimin | 280/7.1 |

FOREIGN PATENT DOCUMENTS

| | | | |
|---|---|---|---|
| 91 07 661.7 | 8/1991 | Germany | A63C 17/04 |
| 189 894 | 11/1936 | Sweden . | |

*Primary Examiner*—Brian L. Johnson
*Assistant Examiner*—Michael Mar
*Attorney, Agent, or Firm*—Baker & Daniels

[57] ABSTRACT

The present invention involves a skate that can be converted from an in-line wheel configuration in which all of the skate wheels are coplanar to a parallel or quad wheel configuration, and vice versa. The skate includes a foot or shoe enclosure (4), a wheel chassis (10), a wheel support (52), at least two wheels (50), and mechanisms which position the wheel chassis at a center point and allows the wheel chassis to pivot the wheels from an in-line to a parallel configuration. The positioning mechanisms include tie rods (18), yokes (84, 86), gear sets (106), and externally mounted rods or panels (116). A post (30) on the bottom of the enclosure may include a threaded portion which is engaged by a nut (36) to rotationally secure the position of the wheel chassis, or the post may include a portion (94) of enlarged diameter supporting a spring (104) which biases the wheel chassis into the post. A brake (122) is provided to allow the user to slow or stop the skate in a controlled manner.

31 Claims, 11 Drawing Sheets

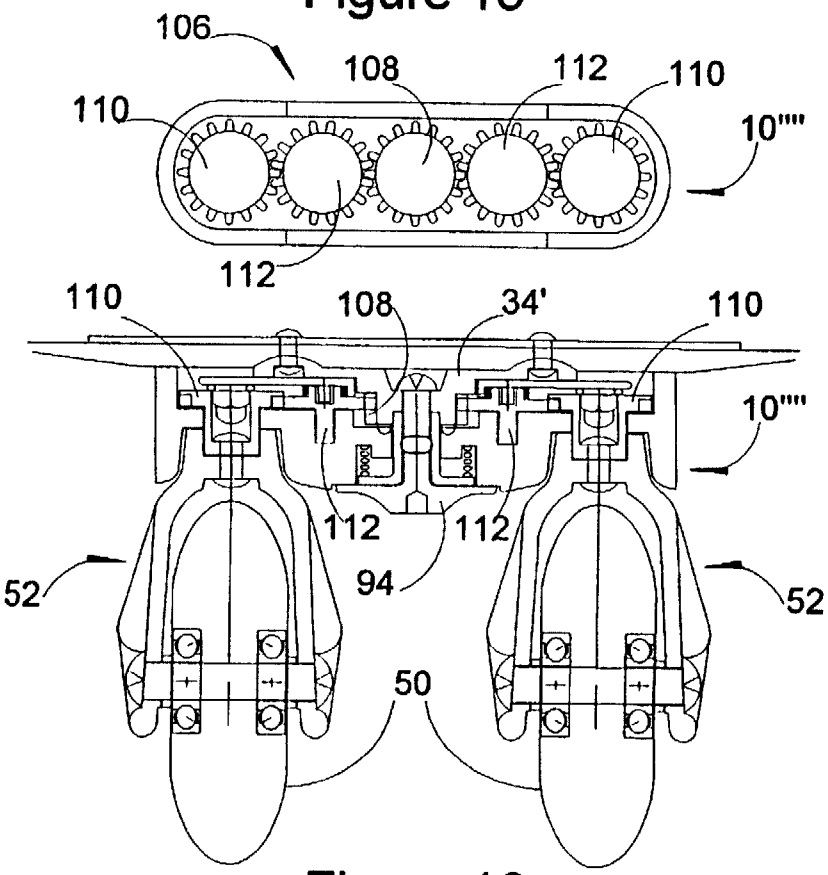
Figure 15
Figure 16
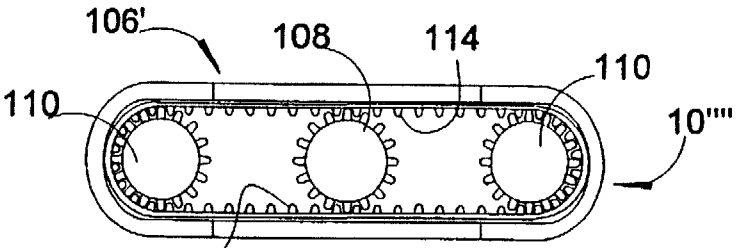
Figure 17
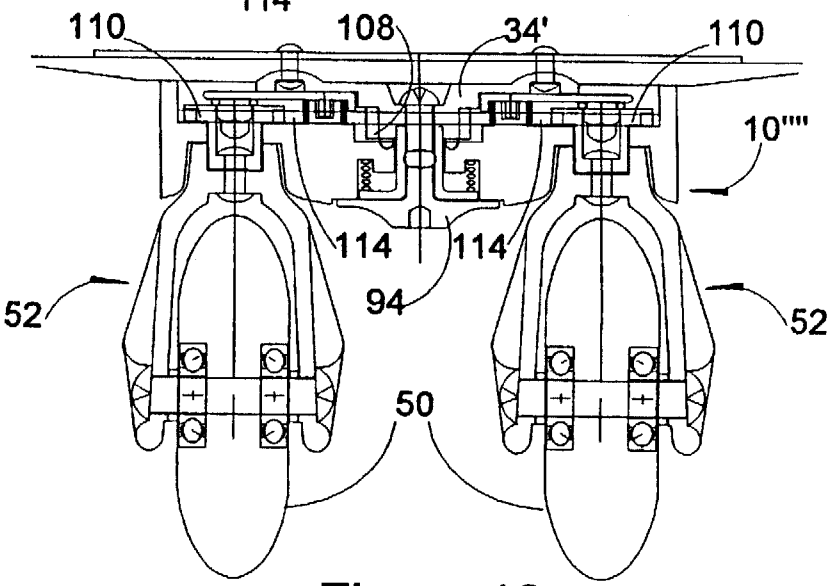
Figure 18

Figure 23
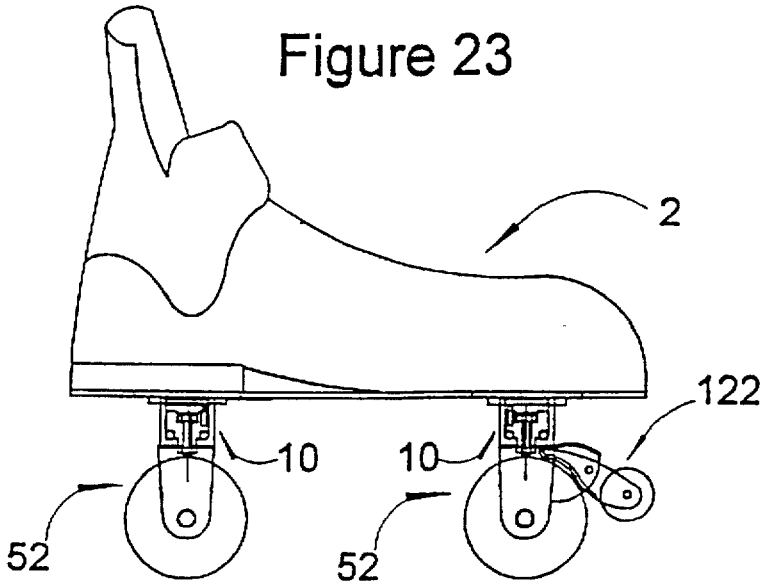
Figure 25
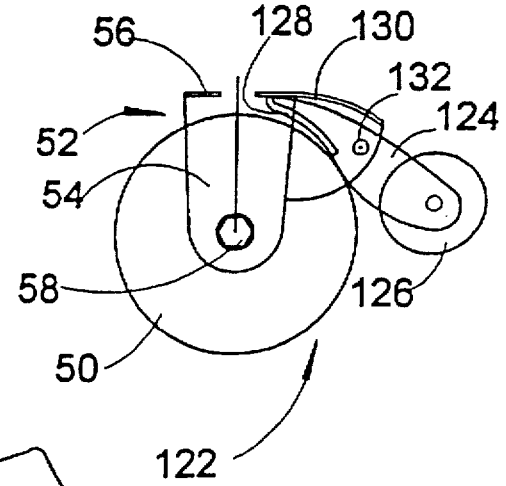
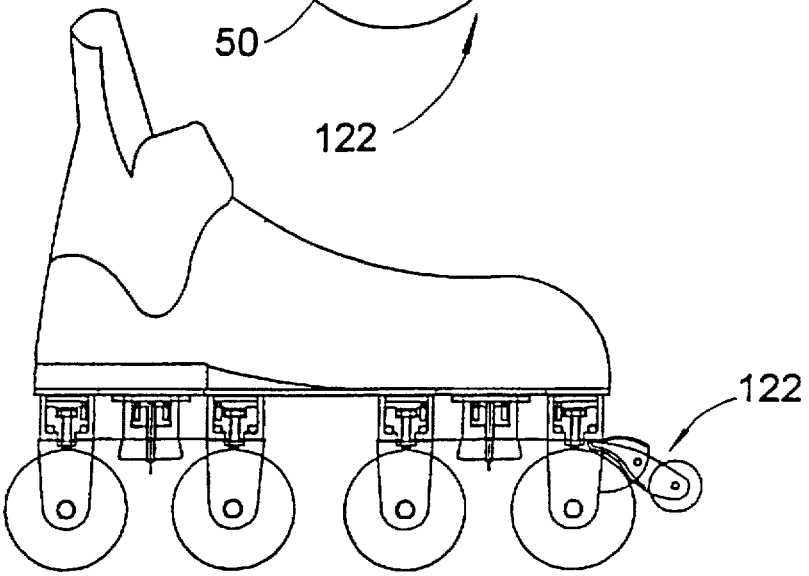
Figure 27

Figure 24
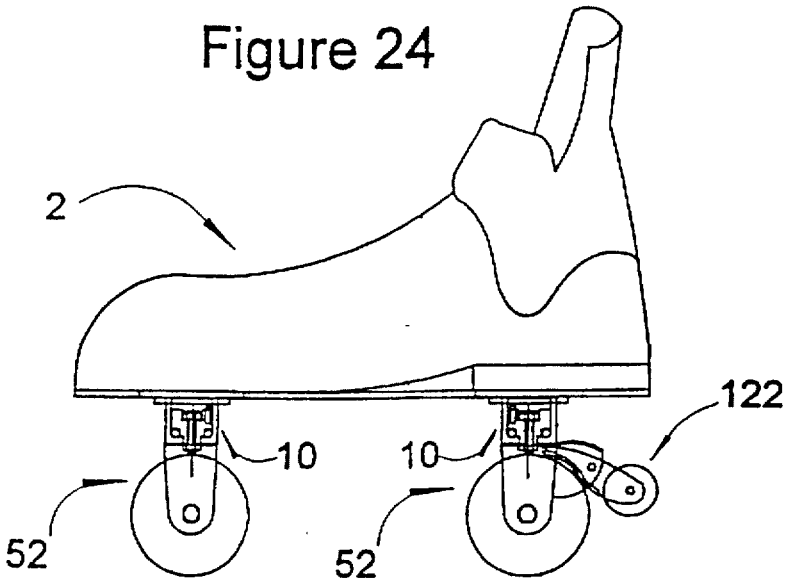
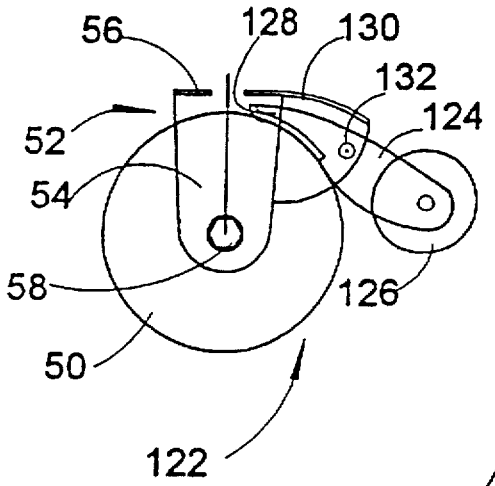
Figure 26
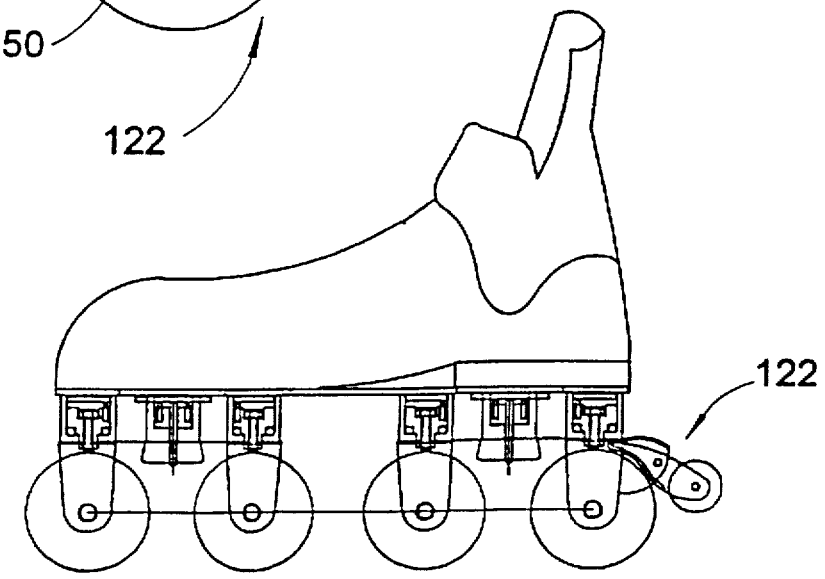
Figure 28

CONVERTIBLE IN-LINE/PARALLEL SKATES

CROSS-REFERENCE TO RELATED APPLICATIONS

The present application is a National Stage Application under 35 U.S.C. § 371 of PCT International Application PCT/US/10082 (International Publication Number WO 96/03187), filed on July 25, 1995, and designating the United States, which is a continuation-in-part of U.S. Pat. Application No. 08/280,806, filed in July 26, 1994, now U.S. Pat. No. 5,524,911.

BACKGROUND OF THE INVENTION

1. Field of the Invention

The present invention relates to sporting goods, and particularly to skates. The field of the invention is that of skates having roller wheels.

2. Description of the Related Art

Skates having roller wheels are used for sporting, exercising, and recreational activities. Two varieties of roller skates are well known and used: in-line and parallel skates. These skate designs typically have four roller wheels, either all four in-line so that the planes of the wheels are all coplanar, or parallel in a two by two, or quad, arrangement. The skate also includes a foot or shoe enclosure with a base or chassis which rotatably supports the axles of the roller wheels. The in-line arrangement provides the wearer with the feel of an ice skate, while the parallel arrangement is more stable. Both arrangements are popular, with some activities being more suited for in-line skates, e.g., traveling over outdoor paths, playing field hockey, and other activities for quad or parallel skates, e.g., skating at roller domes, training skaters.

The foot or shoe enclosure portion of the skate is similar for both arrangements. However, the wheel support portions of the skates are typically made from a fixed frame that rotatably supports the axles of the roller wheels. The sharp contrast between the in-line and parallel arrangement requires that the wheel support portions of those skates be dramatically different. Also, the foot or shoe enclosure portion attaches to each type of wheel support arrangement differently. For example, with in-line skates, two elongated plates can serve as journals for all the roller wheel axles. However, it is impractical to provide parallel skates with common journals because of the increased width between the wheels of the parallel skates, although each pair of the parallel wheels may share a common axle. For a skater to utilize both arrangements, one pair of skates for each arrangement must be obtained.

One known convertible skate allows the substitution of a set of in-line roller wheels with a blade for ice skating. This structure actually requires that an assembly of roller wheels be removed and a separate blade assembly be attached to convert the skates. With this design, the same foot enclosure may be used with either arrangement. However, this design requires that the skater carry the spare parts that are removed and replaced. Further, while this design allows for the substitution of a support for in-line roller wheels and a support for an ice skating blade, it does not provide support for a parallel arrangement of roller wheels.

What is needed is a skate which may be readily converted from an in-line arrangement to a parallel arrangement.

SUMMARY OF THE INVENTION

The present invention provides a skate that can be converted from an in-line wheel configuration in which all of the skate wheels are coplanar to a parallel wheel configuration, and vice versa. In a simple operation, the wheel configuration may be manually converted using only repositioning of the equipment on the skate itself.

Both in-line and quad skates are used for sporting and recreational purposes. The traditional quad skate has enjoyed long-standing popularity, while wide-spread commercialization of the in-line skate is relatively recent. The quad skate is particularly suitable for use in places such as roller rinks, while the in-line skate tends to prevail in outdoor use. Generally, the places and uses of the two types of skates are characteristic to each skate. A skater's choice of an in-line or a quad skate then often depends on the type of activity in which the skater wishes to engage. Thus, a skating enthusiast would require more than one pair of skates to fulfill all skating activities in which he might wish to engage. The skater would thus incur the expense of buying more than one pair of skates, and the inconvenience of having to change skates depending on the activity in which the skater desires to engage at a given time. The present invention utilizes a wheel chassis mounted on posts attached to the bottom of the foot or shoe enclosure. The wheel chassis supports the wheels and is rotatable about the post. A positioning mechanism connects the post to the wheels which are supported by the wheel chassis. The wheel chassis is rotatable between at least two positions, and the connection of the wheels to the post through the positioning mechanism ensures that the angular orientation of the wheels are maintained. One positioning mechanism, namely tie rods, has a predetermined position relative to the post and the wheels so that the wheels are angularly positioned relative to the post. Thus, the tie rods keep the wheels always parallel to the length of the foot or shoe enclosure at the predetermined positions. By rotating the wheel chassis, the wheels may be positioned either in an in-line arrangement, wherein the planes of the wheels are coextensive, and a parallel arrangement, wherein the wheels are parallel and coaxial. Other positioning mechanisms include yokes, gear sets, and externally mounted rods.

By mounting the wheel chassis on the post, many different varieties of foot or shoe enclosures may be utilized with the invention. The posts, in conjunction with the wheel chassis, provide support for the foot or shoe enclosure portion to enhance the rigidity of the foot enclosure and enhance its structural integrity. In one embodiment, two posts are utilized with corresponding wheel chassis and each wheel chassis supports two wheels. This allows for four in-line roller wheels to be employed, which may be readily changed to a two by two parallel arrangement. One method of effecting the change is by loosening a nut which engages the wheel chassis, turning the chassis, and tightening the nut. Another method involves a post with a biasing mechanism for releasing and securing the chassis. The invention comprises, in one form thereof, a skate with an enclosure, at least two wheels, and a wheel chassis attached to the enclosure and rotatably supporting the wheels, which is characterized by a positioning mechanism. The wheels are oriented by the positioning mechanism in one of at least two arrangements, a first in-line arrangement and a second parallel arrangement. The enclosure includes a post extending from a bottom surface of the enclosure, and the wheel chassis is rotatably disposed about the post.

The post includes a threaded portion, and the skate further comprises a nut threadably engaging a threaded portion of the post to rotationally secure the position of the wheel chassis. The post may also include a portion of enlarged diameter supporting a spring which biases the chassis into the post. Another feature of the invention involves an aligning mechanism which orients the chassis relative to the post and may define a plurality of discrete aligned positions for the chassis relative to the post. One embodiment of the positioning mechanism includes two tie rods connecting the post and the wheels. The tie rods have a predetermined length which maintains the angular position of the wheels relative to the post regardless of the angular position of the chassis. Another embodiment of the positioning mechanism includes gears disposed within the chassis and connecting the post and the wheels. One of the gear based positioning mechanism embodiments includes a belt operably connecting the gears. Still another embodiment of the positioning mechanism includes an elongated member disposed externally of the chassis which connects a wheel of one chassis with a wheel of a second chassis so that the rotation of the two chassis are synchronized. The positioning mechanism provides for the wheels to be maintained in an angular position corresponding to the longitudinal direction of the enclosure throughout the rotation of the chassis. The invention also provides a brake mechanism attached to one of the wheels for slowing the skate. The wheels are attached to the chassis via wheel supports which include a U-shaped cross-piece journalling an axle which rotatably supports each wheel. The brake mechanism is mounted on a wheel support, and includes a cantilevered arm pivotally attached to the wheel support adjacent the wheel. The cantilevered arm has one end with a friction surface disposed adjacent to the wheel. The other end of the cantilevered arm includes a rotatably mounted roller.

The invention further includes a yoke mechanism removably connected between the post and wheels, and a biasing mechanism for urging engagement of the yoke mechanism with the post and wheels so that by deactivation of the biasing mechanism, the yoke mechanism allows independent positioning of the wheels. An advantage of the present invention is that a single skate can assume the configuration of either an in-line or a quad skate. Another advantage is that the present invention can easily and quickly be converted from an in-line to a quad skate and vice versa. Another advantage is that the present invention can be converted from an in-line to a quad skate and vice versa without removing or adding any equipment. A further advantage is that the present invention can be used in a variety of locations and under a variety of different conditions calling for skates of different wheel configurations without need for investment in different skates. A further advantage is that the same wheel and support system-of the present invention can be used regardless of the style of the foot or shoe enclosure.

Yet another advantage of the present invention is that the enclosure material surrounding the post is strengthened and the enclosure material thus rigidly supports the wheels and enhances the longevity of the skate.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein:

FIG. 15 is a top plan view of a geared embodiment of the positioning mechanism of the present invention.

FIG. 16 is side sectional view of the embodiment of FIG. 15.

FIG. 17 is a top plan view of a gear and belt embodiment of the positioning mechanism of the present invention.

FIG. 18 is a side sectional view of the embodiment of FIG. 17.

FIG. 23 is a side view of a quad wheel configuration of an embodiment of the present invention having a brake on a front wheel.

FIG. 24 is a side view of a quad wheel configuration of an embodiment of the present invention having a brake on a rear wheel.

FIG. 25 is an enlarged view of a wheel with a brake in a disengaged position.

FIG. 26 is an enlarged view of a wheel with a brake in an engaged position.

FIG. 27 is a side view of an in-line wheel configuration of an embodiment of the present invention having a brake on a front wheel.

FIG. 28 is a side view of an in-line wheel configuration of an embodiment of the present invention having a brake on a rear wheel.

Figure 1:
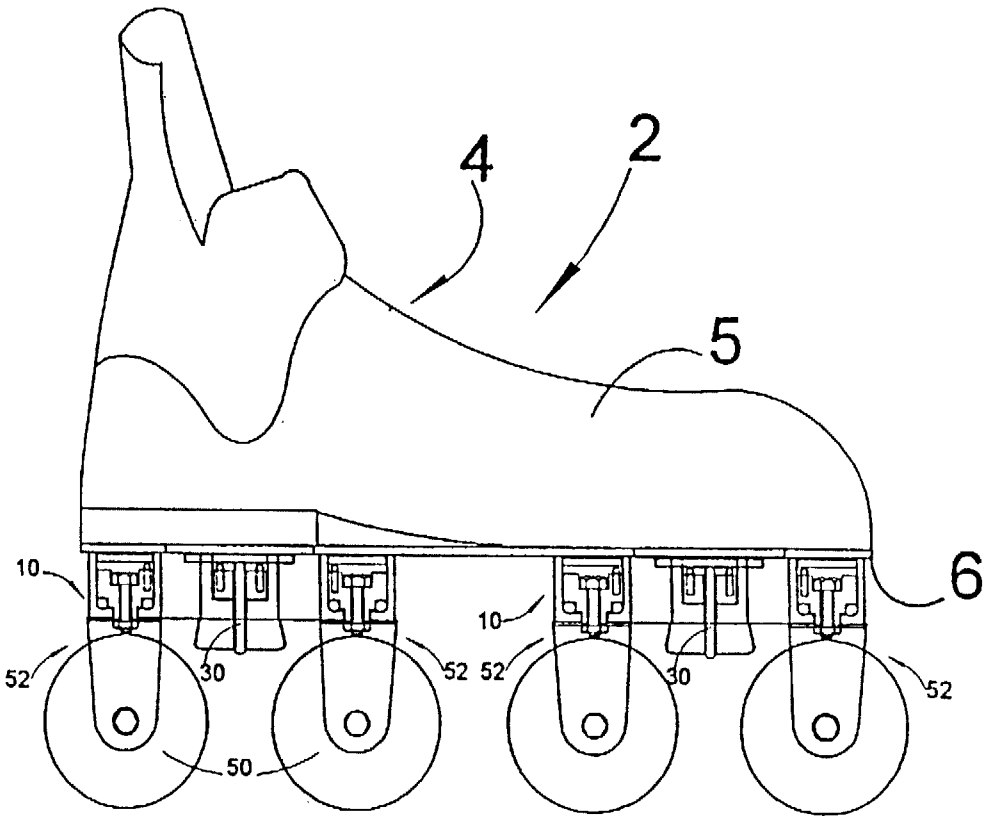
FIG. 1 is a side view of an in-line wheel configuration of an embodiment of the present invention.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates preferred embodiments of the invention, in several forms, and such exemplification is not to be construed as limiting the scope of the invention in any manner.

DESCRIPTION OF THE PREFERRED EMBODIMENT

The preferred embodiment disclosed below is not intended to be exhaustive or limit the invention to the precise forms disclosed in the following detailed description. Rather, the embodiments are chosen and described so that others skilled in the art may utilize their teachings.

In accordance with the present invention, skate 2 includes foot enclosure 4, wheel chassis 10, wheel supports 52, and roller wheels 50. Foot enclosure 4 (FIGS. 1 and 2) includes shoe 5 rigidly attached to shoe base 6. Although a foot enclosure is shown, one of ordinary skill would appreciate that a shoe enclosure could also be used with the present invention. On the underside of the enclosure portion of skate 2, wheel supports 52 may be arranged with wheels 50 in either the in-line arrangement of FIG. 1 or the parallel, quad arrangement of FIG. 2. Skate 2 may be readily converted between these arrangements by simple repositioning of the equipment below shoe base 6. Wheel chassis 10 is rotationally disposed about center post 30 which has threaded portion 32. Center post 30 is rigidly attached to base 34. Center post 30 extends through hole 13 of enclosure or shoe support 11. Shoe support 11 is sandwiched between wheel chassis 10 and shoe base 6 and is rigidly attached to shoe base 6 by attaching wheel chassis 10 to shoe base 6 and post 30. The bottom face of shoe support 11 may have undercut slots that receive and constrain tie rods 18 in a tightened position in either of the in-line or parallel arrangements. Alternatively, the same purpose may be achieved without slots by the bottom face of shoe support 11 being comprised of a resilient material which constrains tie rods 18. Nut 36 is adjustably threaded onto threaded portion 32 to hold wheel chassis 10 against base 34.

Wheel chassis 10 also includes inserts 12 rotatably disposed in an opening of chassis 10. Inserts 12 function as a collar and allow wheel support 52 to rotate relative to wheel chassis 10. Preferably, inserts 12 have a major diameter in the range of 7.5 mm to 44.5 mm. O-rings 19 may be optionally disposed between inserts 12 and chassis 10 to provide resilient dampening to the micro-movement of insert 12. Rod 20 is rigidly attached to insert 12, and to wheels 50 as described below. Inserts 12 include holes 14 which removably receive tie rods 18 which rotatably position inserts 12 relative to chassis 10. Holes 14 are located at a predetermined diameter, preferably about 2–5 mm away from the major diameter, outer perimeter, of insert 12, so that the relative rotation of inserts 12 and wheel chassis 10 is maintained such that whenever wheel chassis 10 is rotated by 900, wheels 50 automatically follow the rotation to keep parallel to the length of enclosure 4. Tie rods 18 functionally connect post 30 and wheel supports 52, and are of precision length to conform to predetermined engineered positions of the skate and wheel chassis. The connection of tie rods 18 with post 30 and wheel supports 52 serves as a positioning mechanism which provides for the automatic positioning of wheels 50. The preferred length of tie rod 18 equals the length of the distance between the axial center of post 30 and the axial center of insert 12, plus the diameter of tie rod 18. The center of holes 14 are preferably disposed at a 45° angle from the axial center of its insert 12 relative to a reference line extending through the center of both inserts 12 when they are disposed in wheel chassis 10. Also, holes 15 in collar 70, as described in greater detail below, are located at a predetermined diameter from the axial center of collar 70, preferably about 2–5 mm away from the major diameter of collar 70, and are also disposed at a 45° angle from the axial center of collar 70 relative to the same reference line.

Wheel supports 52 include crosspieces 56 rigidly attached to rod 20 by nut 22. Alternatively, rod 20 may be connected to wheel supports 52 by a rivet or other suitable attachment. Arms 54 are rigidly attached to crosspiece 56 to form a U-shaped supporting piece. Axle 58 is journalled between arms 54. Wheel 50 rotates about axle 58 and is secured to axle 58 by nut 60. Alternatively, wheel 50 may be connected to axle 58 by a rivet or other suitable attachment. With rod 20 rigidly attached to both insert 12 and wheel support 52, the pivotal movement of insert 12 within wheel chassis 10 causes the angular position of wheel 50 to change relative to wheel chassis 10. However, the structure and arrangement of tie rods 18 ensure that the angular position of wheel 50 relative to enclosure 4 remains substantially constant.

Figure 5:
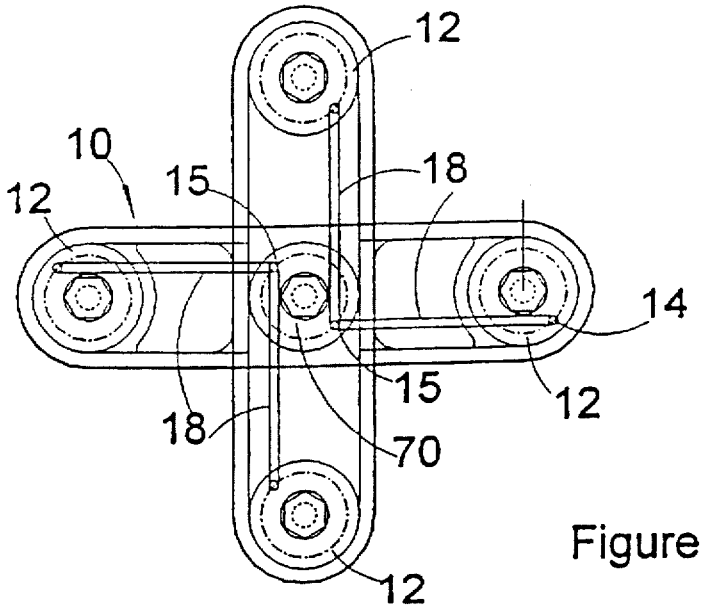
FIG. 5 is a top view of two rotational configurations the wheel assemblies shown in FIGS. 3 and 4.
Figure 6:
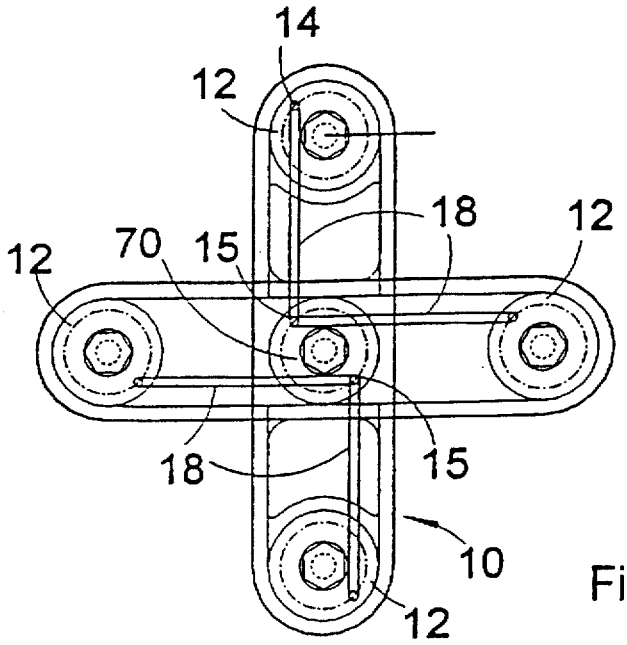
FIG. 6 is another top view of two other rotational configurations of the wheel assemblies shown in FIGS. 3 and 4.
Figure 7:
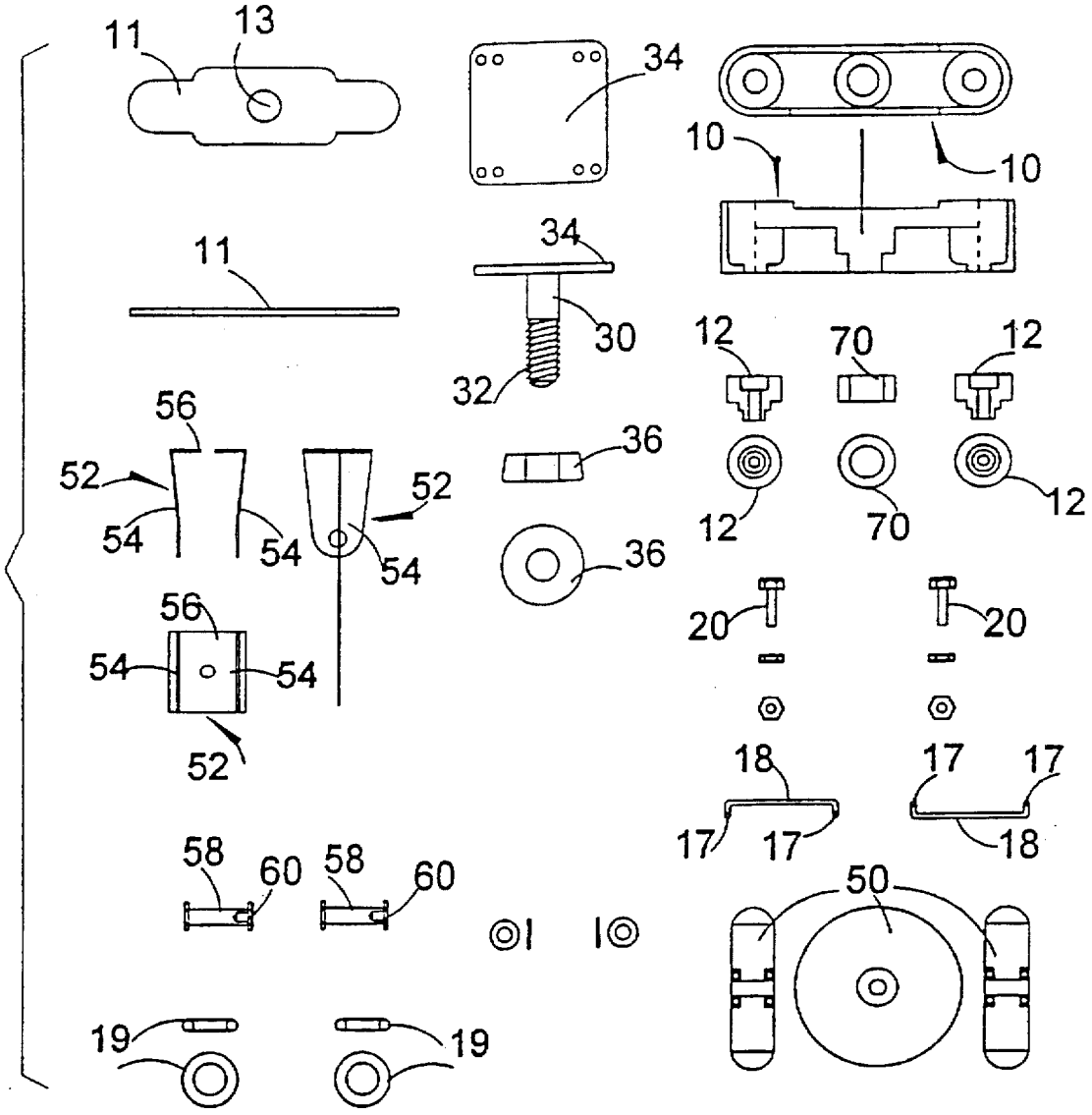
FIG. 7 is an exploded view of various component parts of the embodiment shown in the preceding Figures.
Figure 10:
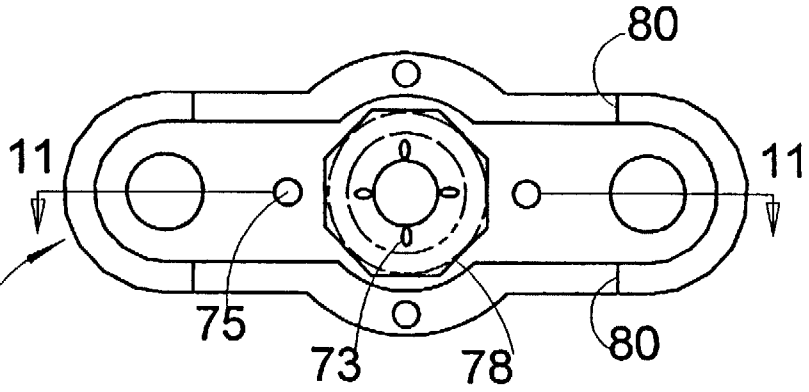
FIG. 10 is a top plan view of a second embodiment of a chassis of the present invention.
Figure 11:
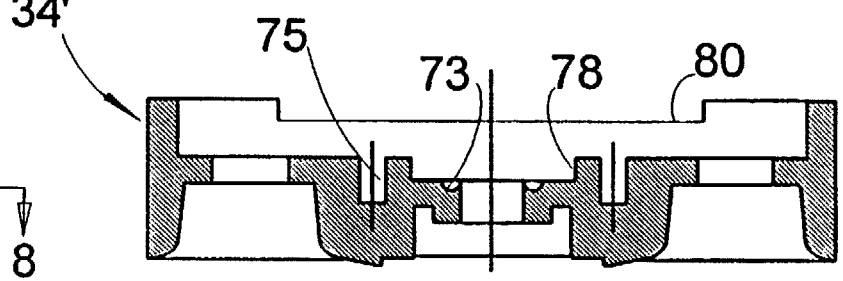
FIG. 11 is a side sectional view of the chassis of FIG. 10.
Figure 8:
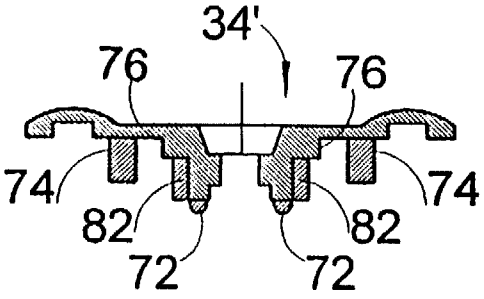
FIG. 8 is a side sectional view of a second embodiment of the base of the present invention.
Figure 9:
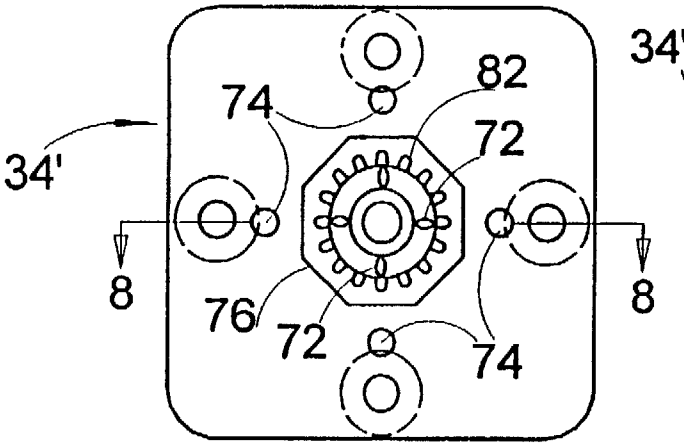
FIG. 9 is a top plan view of the base of FIG. 8.
Figure 13:
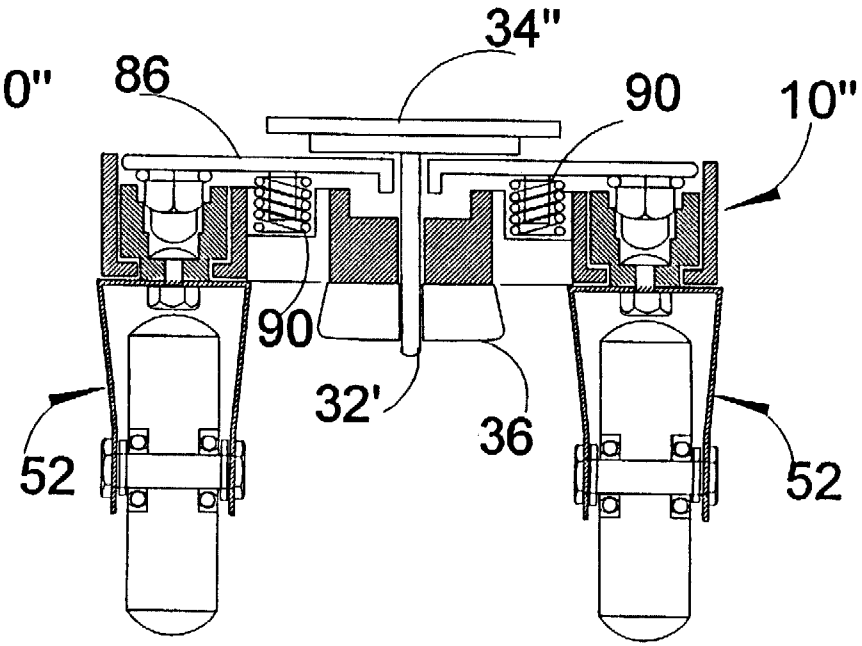
FIG. 13 is a side sectional view of a second embodiment of a yoke and spring adjustment mechanism of the present invention.
Figure 12:
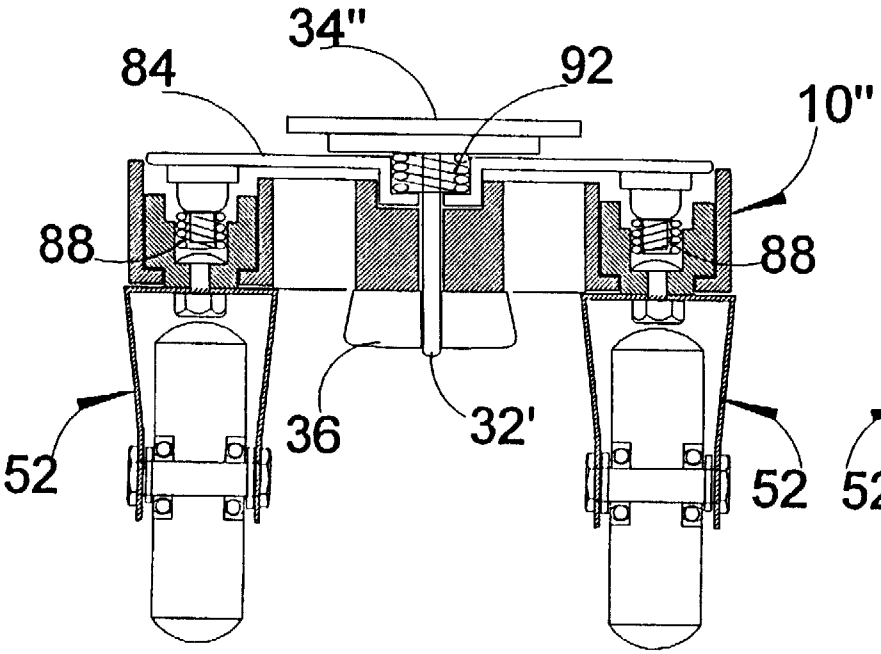
FIG. 12 is a side sectional view of a first embodiment of a yoke and spring adjustment mechanism of the present invention.

To arrange skate 2 in a particular wheel configuration, nut 36 is loosened and wheel chassis 10 is rotated about post 32 to the desired position. The rotation of the wheel support 52 and wheel chassis 10 together causes the skate to assume the configuration of either a quad or in-line skate. As shown in FIGS. 5 and 6, finger 17 at one end of tie rod 18 is pivotally inserted into holes 15 of collar 70, and collar 70 is fixed to center post 30. Finger 17 at the other end of tie rod 18 is pivotally inserted into hole 14 of insert 12. Tie rod 18 is prevented from escaping this position because of the small clearance available when nut 36 attaches chassis 10 to base 34, and because of the constraint by shoe support 11 when nut 36 is tightened. As shown in FIGS. 5 and 6, rotation of wheel chassis 10 pivots tie rod 18 about collar 70, changing the configuration of wheels 50 from an in-line to a parallel or quad position and vice versa.

To obtain the in-line skate wheel configuration shown in FIG. 1, nut 36 is loosened, and wheel chassis 10 is rotated to a position parallel to shoe base 6. As wheel chassis 10 is rotated, tie rod 18 pivots about collar 70, contemporaneously pivoting wheels 50 to a position parallel to shoe base 6. Nut 36 is then tightened on threaded post 32 to maintain wheel chassis 10 in a position parallel to shoe base 6. Optionally, wheel chassis 10 may include a notch or other structure to engage base 34 in this position when nut 36 is sufficiently tightened.

Figure 2:
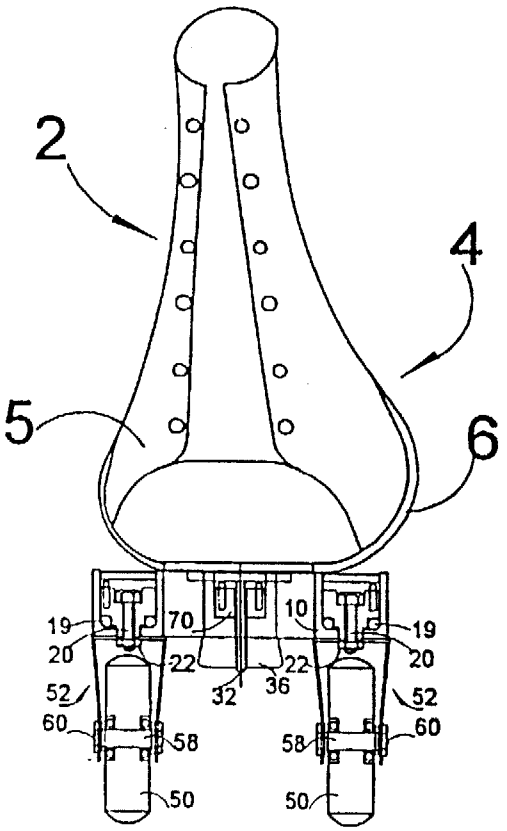
FIG. 2 is a front view, showing both pairs of wheels, of a parallel wheel configuration of an embodiment of the present invention.
Figure 4:
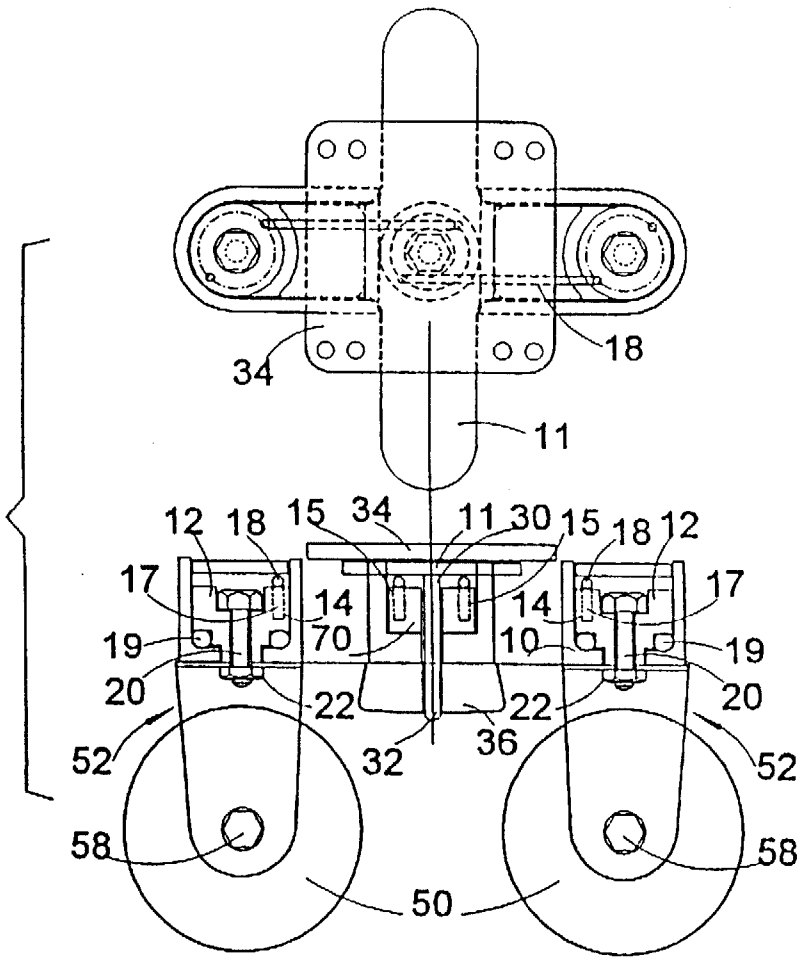
FIG. 4 is a side view of the wheel assembly of FIG. 1.
Figure 3:
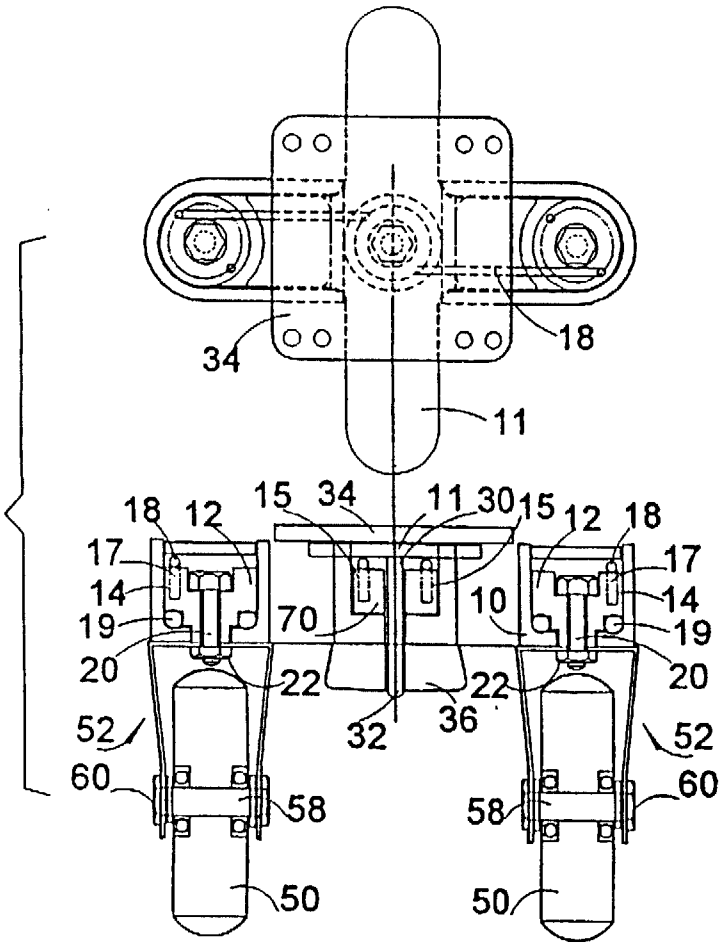
FIG. 3 is a front view of the wheel assembly of FIG. 2.

To obtain the quad skate wheel configuration shown in FIG. 2, nut 36 is loosened, and wheel chassis 10 is rotated to a position perpendicular to shoe base 6. As wheel chassis 10 is rotated, tie rod 18 pivots about collar 70, contemporaneously pivoting wheels 50 to a position parallel to shoe base 6. Nut 36 is then tightened on threaded post 32 to maintain wheel chassis 10 in a position perpendicular to shoe base 6. Optionally, wheel chassis 10 may include a notch or other structure to engage base 34 in this position when nut 36 is sufficiently tightened.

The embodiment of the present invention shown in the drawings includes four wheels; FIG. I shows the four wheels in one line, while FIG. 2 shows the wheels at the four corners of a square or rectangle. Alternatively, a skate defined by the present invention could have virtually any configuration of skate wheels, for example combinations of 2×1 parallel and 1×2 in-line, or 2×3 parallel and 1×6 in-line, or even combinations of odd numbers of wheels for each foot, such as 1+2×1 parallel and 1×3 in-line wheel configurations.

The embodiment of the present invention shown in FIGS. 1 and 2 show an enclosure with closed geometry, such as a shoe, with fixed dimensions. In fact, the enclosure of the skate may have either closed geometry as in a shoe, the enclosure may have open geometry as in a sandal, or the enclosure may be structured and arranged to attach to a shoe or boot. In addition, the enclosure may have either fixed or adjustable dimensions.

Several variations of the present invention are shown in the remaining FIGS. 8–28 and described in greater detail below.

FIGS. 8–11 show several structural modifications to base 34' which align chassis 10'. These aligning features; matching tabs 72 and slots 73 (depicted as equally spaced groups of six), pins 74 and holes 75 (depicted equally spaced groups of four), polygonal projection 76 and indentation 78 (depicted as octagonal), or similar features; constrain the rotational movement of chassis 10' relative to base 34'. Although tabs 72 and projection 76 are shown as part of base 34', and pins 74 and projection 76 as part of chassis 10', one recognizes these matching features may be alternatively be constructed in chassis 10' and base 34', respectively. Also each of the total number of the male portion of the aligning or matching features 72, 74, and 76 each may be less than the total number of their corresponding female matching features 73, 75, and 78. In order for chassis 10' and base 34' to rotate 90° relative to one another, at least two of the female aligning features must be spiced at a 90° angle, which can be achieved by equally spacing an even or choice number of male aligning features. With more than two such female features, the matching male aligning features may temporarily rest in an intermediate orientation and prevent random wheel orientation. Chassis 10' also includes edges 80 which engage the periphery of base 34' in the in-line and quad configuration. Base 34' includes gear teeth 82 for engagement with further embodiments of the positioning mechanism of the present invention which are set forth in greater detail below.

Another variation of the present invention involves a yoke mechanism which allows individual adjustment of the wheel orientation. Yokes 84 and 86 are mounted on posts 32' within chassis 10" and 10'" of FIGS. 12 and 13, respectively. The upper surface of yokes 84 and 86 may have aligning features as disclosed in FIGS. 8–11 above to position the wheels. Similar aligning features may be incorporated between the chassis and each wheel support to individually align the wheels. Springs 88 and 90 are disposed between the yokes and the chassis, or alternatively spring 92 may be disposed between the classics and base 34". When nut 36 is loosened, the resilient biasing of the springs separates the yokes from the chassis so that each wheel may be independently aligned in a parallel or in-line arrangement.

Figure 14:
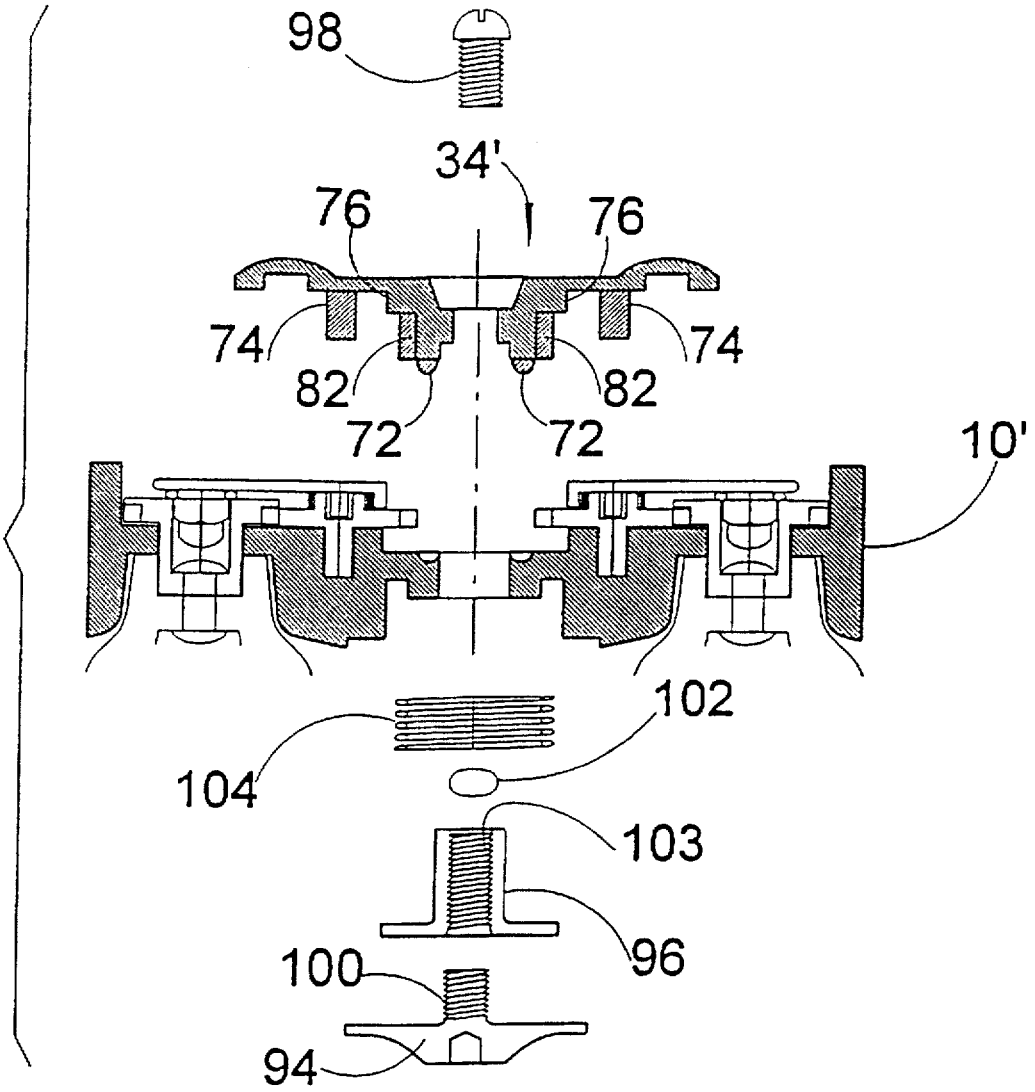
FIG. 14 is an exploded view of the components of another embodiment of the present invention.

As an alternative to nut 36 being tightened on post 32, a modified center post may resiliently connect the chassis to the base, as shown in FIG. 14. In this embodiment, the center post comprises support plate 94, sleeve 96, and connector 98. Connector 98 extends through base 34' to connect with support plate 94. In the disclosed embodiment, connector 98 has external threads which matingly engage internal threads 103 of sleeve 96 which is also in threaded engagement with connecting portion 100 of support plate 94. The connection via sleeve 96 may be facilitated by resilient insert 102 disposed within sleeve 96 between connector 98 and connecting portion 100. spring 104 is disposed around sleeve 96 with one end adjacent to the enlarged diameter portion of post support plate 94 and sleeve 96, and the other end of spring 104 is adjacent to chassis 10'. Under typical operating conditions, spring 104 biases chassis 10' into base 34'. For rotation or reorientation of wheel supports 52, chassis 10' may be pulled down against the force of spring 104 and out of engagement with base 34' so that chassis 10' may be repositioned in either the in-line or parallel arrangement. Once the repositioning is achieved, spring 104 biases chassis 10' back into engagement with base 34'.

Alternative embodiments of the positioning mechanism of the present invention using gears are shown in FIGS. 15–18. FIG. 15 shows chassis 10"" housing gear set 106. Gear set 106 includes post gear 108 fixedly connected to post 94 and base 34', and wheel gears 110 connected with wheel supports 52. Rotation from post gear 108 is transferred to wheel gears 110 through intermediary gears 112 which are mounted in chassis 10"". The contacts between gears 108, 110, and 112 synchronize the orientation of wheel supports 52 when chassis 10"" is rotated about post 94. While intermediary gears 112 are not essential for the functioning of the positioning mechanism, their inclusion allows for all of the gears to have a smaller size.

The embodiment of FIGS. 17 and 18 is similar to the embodiment of FIGS. 15 and 16 described above, except for the substitution of toothed belt 114 as the motion transfer mechanism of gear set 106'. Toothed belt 114 is disposed within chassis 10"" and engages post gear 108 and wheel gears 110. Similar to the embodiment of FIGS. 15 and 16, rotation of chassis 10""causes toothed belt 114 to move and rotate wheel gears 110 in synchronized fashion.

Figures 19, 20, 21, 22:
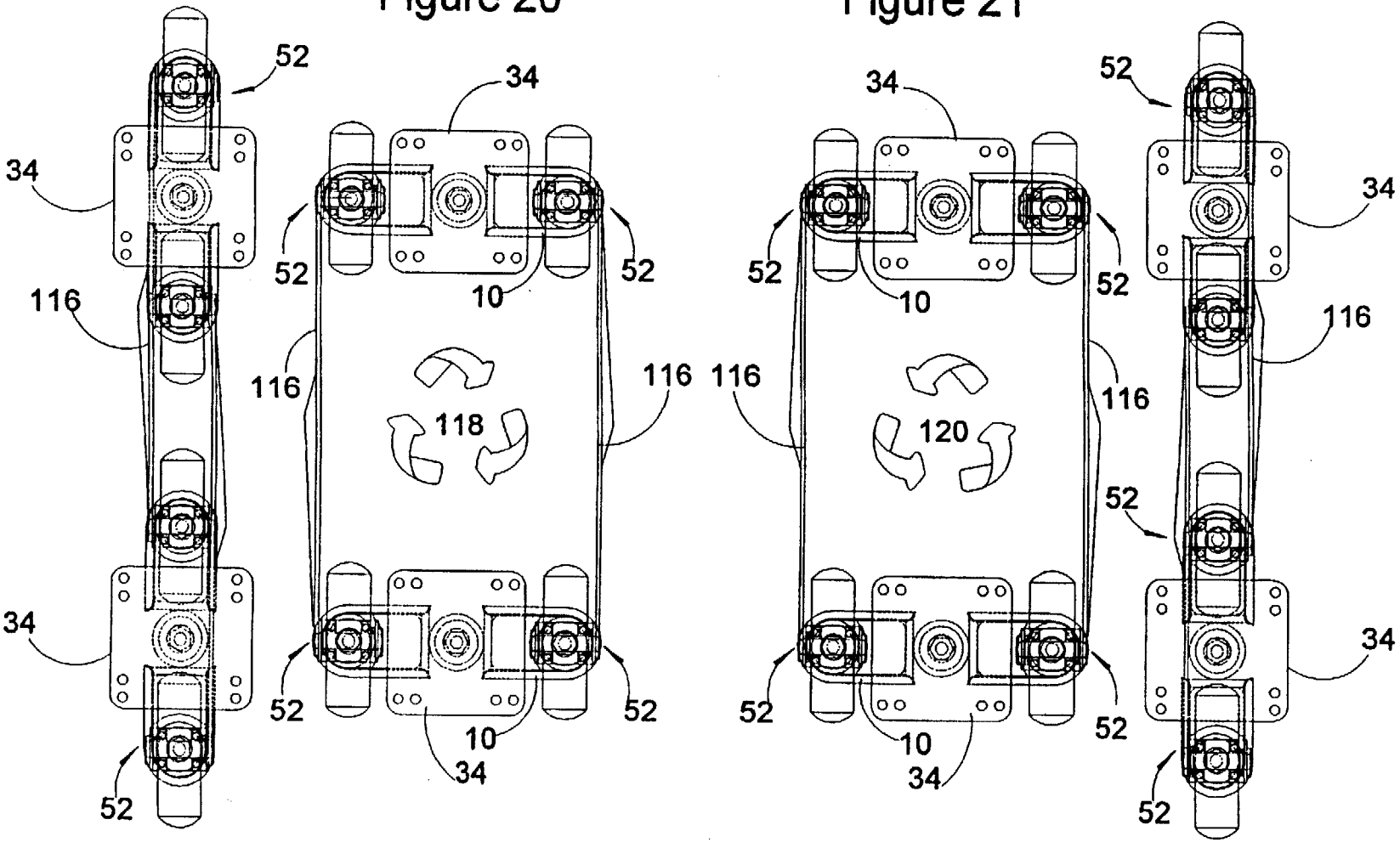
FIG. 19 is a top plan view of an embodiment of the present invention having an external positioning mechanism in a first position.
FIG. 20 is a top plan view of an embodiment of the present invention having an external positioning mechanism in a second position.
FIG. 21 is a top plan view of an embodiment of the present invention having an external positioning mechanism in a third position.
FIG. 22 is a top plan view of an embodiment of the present invention having an external positioning mechanism in a fourth position.

Another embodiment of the present invention, wherein the positioning mechanism is located externally of the chassis, is shown in FIGS. 19–22. An elongate member such as rods or panels 116 are attached to specific locations on the periphery of wheel supports 52 so that the entire assembly of chassis 10 and rods 116 moves together when one of chassis 10 is rotated relative to its base 34. In the exemplary embodiment rods 116 are disposed perpendicularly to the axis of axle 58. As indicated by arrows 118, the parallel or quad arrangement of FIG. 20 is transformed into the in-line arrangement of FIG. 19 by the clockwise rotation of chassis 10. similarly, arrows 120 of FIG. 21 illustrate how the counterclockwise rotation of chassis 10 transforms a parallel or quad arrangement into an in-line arrangement such as shown in FIG. 22. Thus, rods 116 each connect two wheel supports 52 on the same side of the skate, and maintain the same distance and longitudinal orientation throughout the rotation of chassis 10.

The present invention also includes brake 122 as shown in FIGS. 23–28. Brake 122 comprises cantilevered arm 124 having roller 126 at one end and friction surface 128 at the other end. Support plate 130 is fixed to, or integrally formed with, wheel support 52 and supports pivot 132 about which cantilevered arm 124 moves. Brake 122 may be attached to one of a front or rear wheel 50, or both, and adjacent the toe or heel region of skate 2, such that in an in-line arrangement the wheel 50 having brake 122 must be either the first or last wheel. In the quad or parallel arrangement, brake 122 is simply on the side of the pair of front or rear wheels.

The braking action is activated by the skater inclining skate 2 so that roller 126 contacts the surface over which skate 2 is traversing. The contact of roller 126 pivots arm 124 so that friction surface 128 compresses wheel 50. The friction between friction surface 120 and wheel 50 slows the rotation of wheel 50, thus applying braking action. In the in-line arrangement, the braked wheel is the only wheel rotating on the skating surface, while in the quad or parallel arrangement another wheel may also be rotating on the skating surface. Unlike conventional skate brakes which create friction directly with the skating surface, the friction surface of the present invention does not contact the skating surface, thus greatly reducing wear on the brake. In addition, the brake of the present invention still allows the user to skate while breaking, providing the skater with greater control of the skating and braking manoeuver.

While this invention has been described as having a preferred design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A convertible skate comprising:

an enclosure a base frame attached to said enclosure;

at least one vertical post attached to said base frame;

at least one wheel chassis, each said wheel chassis including a chassis body pivotably attached to said vertical post, a pair of wheels, a pair of wheel supports for rotatably supporting said wheels in vertical rotational planes relative to a ground surface, each said wheel support being pivotably connected to a respective end of said wheel chassis for movement about a vertical axis, said wheel chassis further including means for connecting said wheel supports to a fixed member located proximate said vertical post, said connecting means changing the pivotal position of the vertical axes of said wheel supports in response to pivotal movement of said wheel chassis relative to said vertical post; and positioning means for selectively positioning said chassis in a selected one of a plurality of pivotal positions whereby the vertical rotational planes of said pair of wheels may be selectively arranged either in-line along a longitudinal axis of the skate or transversely along each side of the longitudinal axis in response to a selected pivotal position of said wheel chassis.

2. The skate of claim 1 wherein said positioning means includes a threaded portion of said post and a fastener threadably engaging said threaded portion to rotationally secure the position of said wheel chassis.

3. The skate of claim 1 wherein said connecting means includes two tie rods, each said tie rod connecting a respective one of said pair of wheels.

4. The skate of claim 3 further comprising a collar fixed to said vertical post and engaging said tie rods, and each said tie rod is pivotally connected to a respective one of said pair of wheels.

5. The skate of claim 4 further including two inserts rotatably disposed in said wheel chassis and fixed to a respective one of said pair of wheels each, said tie rod being pivotally connected to a respective one of said inserts.

6. The skate of claim 3 wherein said tie rods have a predetermined length which maintains the angular position of said pair of wheels relative to said enclosure regardless of the angular position of said wheel chassis.

7. The skate of claim 6, further including two inserts rotatably disposed in said wheel chassis and fixed to a respective one of said pair of wheels each, said tie rod being pivotally connected to a respective one of said inserts, wherein said predetermined length substantially equals the distance between the center of said vertical post and the center of said insert, and the ends of each said tie rod are so connected such that the line connecting one end of said tie rod to the center of said post and the line connecting the other end of said tie rod to the center of said insert are both at a 45° angle relative to the center line defined by the centers of said inserts.

8. The skate of claim 1 wherein each of said pair of wheels includes a U shaped crosspiece journalling an axle which rotatably supports a roller wheel.

9. The skate of claim 1 wherein said vertical post includes a base rigidly attached to said enclosure.

10. The skate of claim 1 wherein said post includes a portion of enlarged diameter supporting a biasing means which biases said wheel chassis into said post.

11. The skate of claim 1 wherein said connecting means includes gears disposed within said wheel chassis and connecting the fixed member and one of said wheels.

12. The skate of claim 1 wherein said positioning means includes a yoke operably connecting the fixed member and one of said wheels, and biasing means for urging engagement of said yoke with the fixed member and said wheels so that by deactivation of said biasing means, said yoke allows independent positioning of said wheels.

13. The skate of claim 1 further comprising a second chassis supporting a second pair of wheels, said connecting means includes an elongate member disposed externally of said chassis and said second chassis, said elongate member connecting one of said wheels of said wheel chassis with one of said wheels of said second wheel chassis so that the rotation of said wheel chassis and said second wheel chassis is synchronized.

14. The skate of claim 1 further comprising means for securing said chassis relative to the fixed member.

15. The skate of claim 14 wherein said securing means includes a plurality of discrete aligned positions for said wheel chassis relative to the fixed member.

16. The skate of Claim 1 futher comprising brake means attached to one of said wheels for slowing said skate.

17. The skate of claim 16 wherein each said wheel support includes a U-shaped crosspiece journalling an axle which rotatably supports each of said wheels, said brake means being mounted on one of said wheel supports.

18. The skate of claim 17 wherein said brake means includes a cantilevered arm pivotally attached to said one of said wheel supports adjacent said one of said wheels, said cantilevered arm having one end with a friction surface disposed adjacent to said wheel.

19. The skate of claim 18 further comprising a roller rotatably mounted on the other end of said cantilevered arm.

20. The skate of claim 1 wherein said connecting means provides for synchronized orientation of said wheels, and said wheels are maintained in an angular position corresponding to the longitudinal direction of said enclosure throughout the rotation of said wheel chassis.

21. The skate of claim 20 further comprising a belt operably connecting said gears.

22. The skate of claim 3 wherein said enclosure includes a collar fixed to the fixed member and engaging said tie rods, and said tie rods are pivotally connected to said pair of wheels.

23. The skate of claim 22 further comprising two inserts rotatably disposed in said wheel chassis and fixed to a respective one of said pair of wheels, said tie rods being pivotally connected to a respective one of said inserts.

24. A combination wheel support and chassis for use in a roller skate, said combination comprising:

a pair of wheels;

a pair of wheel supports for rotatably supporting said wheels in vertical rotational planes relative to a ground surface;

a chassis body having means for pivotably attaching to a vertical post of the roller skate, each said wheel support being pivotably disposed in a respective end of said chassis for movement about a vertical axis, said wheel chassis further including means for connecting said wheel supports to the vertical post, said connecting means changing the pivotal position of the vertical axes of said wheel supports to a selected one of a plurality of pivotal positions in response to pivotal movement of said wheel chassis relative to the vertical post, whereby the vertical rotational planes of said pair of wheels may be selectively arranged either in-line along a longitudinal axis of the skate or transversely along each side of the longitudinal axis in response to a selected pivotal position of said wheel chassis; and brake means attached to one of said wheels for slowing said wheel support and chassis.

25. The combination of claim 24 further comprising a collar adapted to be attached to a base associated with the vertical post, said wheel chassis having a central bore shaped to receive said collar.

26. The combination of claim 25 wherein said connecting means includes a pair of tie rods, wherein said tie rods pivotally engage said collar and a respective one of said wheel supports.

27. The combination of claim 26 wherein said tie rods have a predetermined length which maintains the angular position of said pair of wheels relative to said longitudinal axis of the skate regardless of the angular position of said wheel chassis relative to said longitudinal axis of the skate.

28. A combination wheel support and chassis for use in a roller skate, said combination comprising:

at least two wheels;

at least two rotational support collars, each said wheel attached for movement in a vertical rotational plane to an associated one of said rotational support collars;

a wheel chassis rotatably disposed on a vertical post of the roller skate, each said wheel support collar being pivotably connected to a respective end of said wheel chassis for movement about a vertical axis;

a connector connecting said vertical post of said roller skate to each of said rotational support collars and changing the pivotal position of the vertical axes of said wheel support collars to a selected one of plurality of pivotal positions in response to pivotal movement of said wheel chassis relative to the vertical post; and a yoke mechanism engaging said wheel chassis and said vertical post in a selected pivotal position whereby the vertical rotational planes of said at least two wheels may 15 be selectively arranged either in-line along a longitudinal axis of the skate or transversely along each side of the longitudinal axis in response to the selected pivotal position of said wheel chassis.

29. The combination of claim 28 further comprising a collar adapted to be attached to a base associated with the vertical post, said wheel chassis having a central bore shaped to receive said collar.

30. The combination of claim 29 wherein said connector comprises a pair of tie rods, each said tie rod pivotally engaging said collar and a respective one of said wheel supports.

31. The combination of claim 30 wherein said tie rods have a predetermined length which maintains the angular position of said pair of wheels relative to said longitudinal axis of the skate regardless of the angular position of said wheel chassis relative to said longitudinal axis of the skate.

* * * * *

UNITED STATES PATENT AND TRADEMARK OFFICE

CERTIFICATE OF CORRECTION

PATENT NO. : 5,775,705

DATED : July 7, 1998

INVENTOR(S) : Jimmy Cochimin

It is certified that error appears in the above-identified patent and that said Letters Patent is hereby corrected as shown below:

Claim 28, Col. 12, Line 17 delete "15".

Signed and Sealed this

Sixteenth Day of March, 1999

*Attest:*

*Attesting Officer*

Q. TODD DICKINSON

*Acting Commissioner of Patents and Trademarks*